US006415954B1

(12) United States Patent
Lee

(10) Patent No.: US 6,415,954 B1
(45) Date of Patent: Jul. 9, 2002

(54) DEVICE FOR DISPENSING ROUND-SHAPED ARTICLES WITHOUT JAMMING

(76) Inventor: Dae-Sik Lee, Sunkyung Apt 6-1201, 592 Sungpo-dong, Ansan City, Kyungki-Do (KR)

( * ) Notice: Subject to any disclaimer, the term of this patent is extended or adjusted under 35 U.S.C. 154(b) by 0 days.

(21) Appl. No.: 09/546,617

(22) Filed: Apr. 10, 2000

(30) Foreign Application Priority Data

Aug. 2, 1999 (KR) ..... 99-31730

(51) Int. Cl.[7] ..... B65H 3/50
(52) U.S. Cl. ..... 221/203; 221/277
(58) Field of Search ..... 221/7, 13, 15, 221/200, 203, 208, 277, 282, 311, 185

(56) References Cited

FOREIGN PATENT DOCUMENTS

JP 4-260481 * 9/1992

* cited by examiner

*Primary Examiner*—Kenneth W. Noland
(74) *Attorney, Agent, or Firm*—Harrison & Egbert

(57) ABSTRACT

A round-shaped article dispensing device, including a dispensing barrel and a guide member. The dispensing barrel is provided with a discharge hole that is selectively opened and closed by a door. The guide member is disposed in the dispensing barrel and is provided with a guide slit that is slanted and extended from the interior of the dispensing barrel to the discharge hole. The guide slit may be spirally formed along the wall of the guide member.

6 Claims, 2 Drawing Sheets

DEVICE FOR DISPENSING ROUND-SHAPED ARTICLES WITHOUT JAMMING

TECHNICAL FIELD

The present invention relates, in general, to dispensing devices and, more particularly, to a device for dispensing round-shaped articles without jamming, capable of dispensing a plurality of round-shaped articles while preventing the articles from jamming the discharge hole of the device, thereby allowing a user to dispense the articles conveniently and permitting the user to dispense the articles in a short time.

BACKGROUND ART

In the past, in order to put to use round-shaped articles, such as tablets, candy or ball bearings, a user whould have picked up or taken out a desired quantity of articles from a storage container and would have divided the articles.

However, such a manual dispensing method causes the user inconvenience, and may deteriorate and damage the articles.

In order to solve such a problem, there was proposed a device for dispensing round-shaped articles. The conventional round-shaped article dispensing device comprises a dispensing barrel and a door. The dispensing barrel has a discharge hole for discharging a desired quantity of round-shaped articles and the dispensing barrel. The door selectively opens and closes the discharge hole.

According to the conventional round-shaped article dispensing device, when the door is opened after round-shaped articles are contained in the dispensing barrel, a certain quantity of the round-shaped articles are discharged through the discharge hole.

However, according to the conventional round-shaped article dispensing device, since the round-shaped articles jam the discharge hole because the round-shaped articles are simply contained in a dispensing barrel and the articles are discharged directly through the discharge hole, the discharge hole may become blocked and the articles are not discharged properly, thereby causing a user inconvenience and increasing the time for in dispensing the articles.

SUMMARY OF THE INVENTION

Accordingly, the present invention has been made keeping in mind the above problems occurring in the prior art, and an object of the present invention is to provide a device for dispensing round-shaped articles without jamming, capable of dispensing a plurality of round-shaped articles while preventing the articles from jamming the discharge hole of the dispensing device, thereby allowing a user to dispense the articles conveniently and permitting the user to dispense the articles in a short time.

In order to accomplish the above object, the present invention provides a round-shaped article dispensing device, comprising a dispensing barrel provided with a discharge hole that is selectively opened and closed by a door, and a guide member disposed in the dispensing barrel and provided with a guide slit that is slanted and extended from the interior of the dispensing barrel to the discharge hole.

According to another embodiment, the guide slit may be spirally formed along the wall of the guide member.

BRIEF DESCRIPTION OF THE DRAWINGS

The above and other objects, features and other advantages of the present invention will be more clearly understood from the following detailed description taken in conjunction with the accompanying drawings; in which.

DETAILED DESCRIPTION OF THE INVENTION

Figure 1:
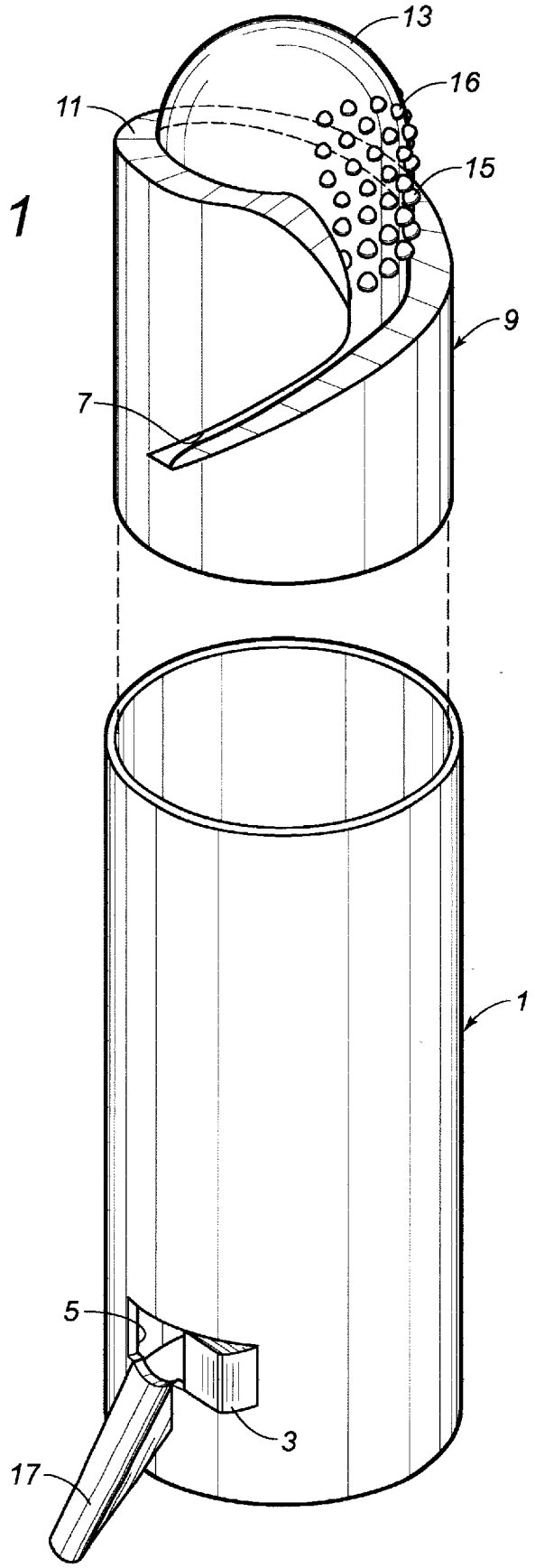
FIG. 1 is an exploded perspective view showing a round-shaped article dispensing device according to a preferred embodiment of the present invention.
Figure 2:
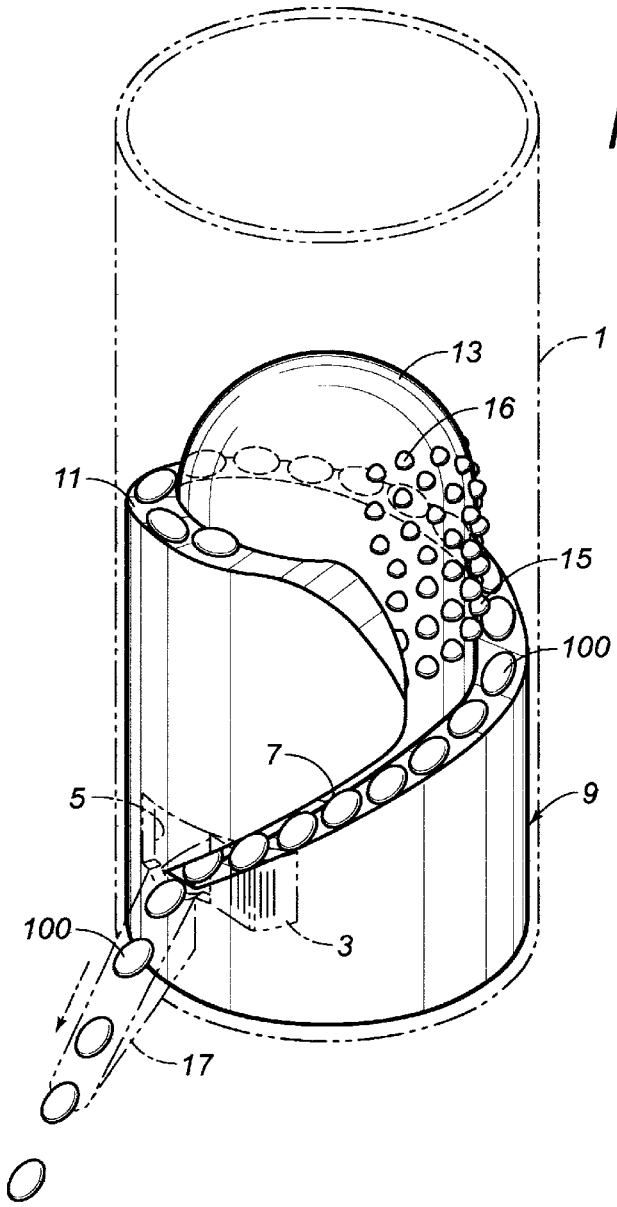
FIG. 2 is a perspective view showing the assembled round-shaped article dispensing device.
Figure 3:
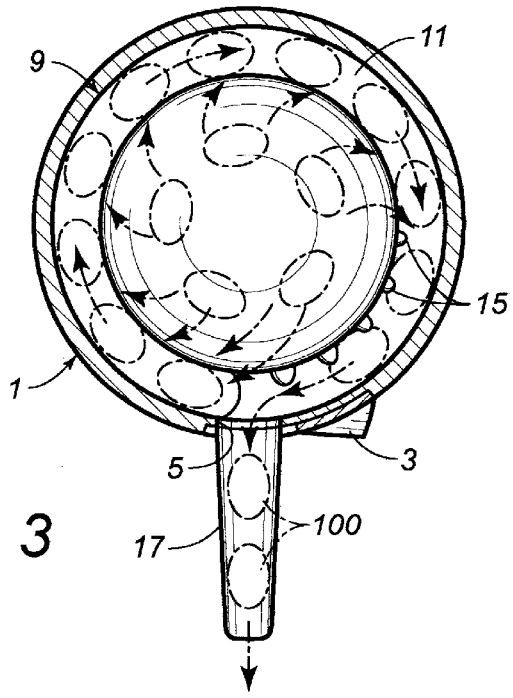
FIG. 3 is a horizontal cross section showing the operation of the round-shaped article dispensing device.

Referring to FIGS. 1 to 3, a device for dispensing round-shaped articles without jamming according to the present invention includes a dispensing barrel 1 that contains round-shaped articles.

The dispensing barrel 1 is provided with a discharge hole 5 for dispensing round-shaped articles that are contained in the dispensing barrel 1. The discharge hole 5 is provided with an opening and closing door 3 for selectively opening and closing the discharge hole 5.

A guide member 9 is disposed in the dispensing barrel 1. The guide member 9 has a guide slit 7 that is slanted and is extended from the interior of the dispensing barrel 1 to the discharge hole 5. The guide slit 7 serves to guide the round-shaped articles toward the discharge hole 5 in a line.

The dispensing barrel 1 is preferably made of transparent or translucent material so that a user may see the interior of the dispensing barrel 1. In order to prevent the articles from deterioration, the dispensing barrel 1 may be covered with an ultraviolet ray intercepting film (not shown). The top of the dispensing barrel 1 may be opened or covered with a lid (not shown).

In order to prevent the articles from jamming the discharge hole of the dispensing device, the guide slit 7 is formed to be slanted and spiral and forms an angle ranging from 25° to 75°.

The guide slit 7 may have a uniformly sized height that should be large enough to guide the articles to the discharge hole 5. The guide slit 7 may have a height that is enlarged in a direction toward the discharge hole 5.

The guide slit 7 may be formed spirally along the sidewall of the guide member 9 to have a certain length or a certain number of turns.

A spiral guide surface 11 is formed on the top of the guide member 9 and is extended to the entrance of the guide slit 7, so as to guide the articles toward the guide slit 7 while spreading out the articles.

The width of the wall of the guide member 9 or spiral surface 11 may be preferably determined in accordance with the size of the articles so as to guide the articles without obstruction.

In order to distribute the articles without congestion, a distributing member 13 is fitted into the hollow center portion of the guide member 9 with its top portion being projected higher than a position of the top of the guide member 9. The top portion of the distributing member 13 may preferably be dome-shaped, so that the articles on the top portion of the distributing member 13 are slid down more evenly onto the guide surface 11. This distributing member 13 is sized according to the size of the articles.

A plurality of spaced projections 15 and 16 are formed on the exposed side surface of the distributing member 13 and are disposed to guide the articles to the entrance of the guide slit 7 one by one while arranging the articles in a line.

The size of projections 15 and 16 becomes smaller along the downward direction and along the direction from one side to the other side so as to efficiently arrange the articles in a line on the guide surface 11 and to allow the articles to enter the guide slit 7 one after another along the guide surface 11.

A chute 17 is connected to a position of the outer surface of the dispensing barrel 1 near the discharge hole 5 at its one end so as to slide down the articles 100 that are discharged through the discharge hole 5.

In order to dispense the articles 100 using the dispensing device of the present invention, a user should put the articles 100 into the interior of the dispensing barrel 1 while having shut the door 3 of the dispensing barrel 1.

As shown in FIG. 3, when the articles 100 are put into the interior of the dispensing barrel 1, the articles 100 are arranged in a line on the guide surface 11 by the projections 15 and 16 after being distributed outwardly in the radial direction by the distributing member 13.

Since the articles 100 on the guide surface 11 are prevented from directly entering the guide slit 7 and enter the guide slit 7 one after another along the guide surface 11 by the action of the projections 15 and 16, they are finally arranged in a line along the guide slit 7. When the dispensing barrel 1 is shaken, the drawing-up action may be performed more effectively.

Then the door 3 is opened, and the articles 100 are discharged out of the dispensing barrel 1 through the discharge hole 5 and, subsequently, are slid down through the chute 17. If necessary, a user may divide the slid articles into several groups.

As described above, the present invention provides a device for dispensing round-shaped articles without jamming, capable of dispensing a plurality of round-shaped articles while preventing the articles from jamming the discharge hole of the device, thereby allowing a user to dispense the articles conveniently and permitting the user to dispense the articles in short time.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

I claim:

1. A device for dispensing a round-shaped article comprising:

a dispensing barrel having a discharge hole and a door, said discharge hole being selectively openable and closeable by said door;

a guide member disposed in said dispensing barrel, said guide member having a slanted guide slit extending from an interior of said dispensing barrel to said discharge hole; and a distributing member having an exposed dome-shaped top portion fitted into an interior of said guide member.

2. The device of claim 1, further comprising:

a plurality of various sized projections formed on an exposed side surface of said distributing member.

3. The device of claim 1, further comprising:

a chute connected at a position on an outer surface of said dispensing barrel adjacent said discharge hole at one end of said dispensing barrel.

4. A device for dispensing a round-shaped article comprising:

a dispensing barrel having a discharge hole and a door, said discharge hole being selectively openable and closeable by said door;

a guide member disposed in said dispensing barrel, said guide member having a slanted guide slit extending from an interior of said dispensing barrel to said discharge hole, said guide slit being spirally formed along a wall of said guide member; and a distributing member having an exposed dome-shaped top portion fitted into an interior of said guide member.

5. The device of claim 4, further comprising:

a plurality of various sized projections formed on an exposed side surface of said distributing member.

6. The device of claim 4, further comprising:

a chute connected at a position on an outer surface of said dispensing barrel adjacent said discharge hole at one end of said dispensing barrel.

* * * * *